United States Patent [19]

Beagle, Jr.

[11] Patent Number: 5,016,794

[45] Date of Patent: May 21, 1991

[54] QUICK RELEASE SKATEBOARD BACKPACK

[76] Inventor: Donald L. Beagle, Jr., 4528 Tabony St., Apt. A, Metairie, La. 70006

[21] Appl. No.: 498,559

[22] Filed: Mar. 26, 1990

[51] Int. Cl.[5] ..... A45F 3/04

[52] U.S. Cl. ..... 224/211; 224/247; 224/262; 224/907; 211/60.1

[58] Field of Search ..... 224/209-211, 224/215, 216, 242, 247, 259-262, 907, 910, 913, 917, 149, 202, 248, 250, 263; 211/60.1, 87; 248/205.1, 310

[56] References Cited

U.S. PATENT DOCUMENTS

| | | | |
|---|---|---|---|
| D. 258,703 | 3/1981 | Ogle et al. | D3/36 |
| 4,337,883 | 7/1982 | Pate | 224/250 |
| 4,518,107 | 5/1985 | Amos | 224/215 |
| 4,790,460 | 12/1988 | Harper, Jr. | 224/259 |

*Primary Examiner*—Henry J. Recla
*Assistant Examiner*—Robert M. Fetsuga
*Attorney, Agent, or Firm*—David L. Ray

[57] ABSTRACT

In accordance with the present invention there is provided a backpack for holding and carrying a skateboard. The skateboard backpack of the invention includes a flexible frame for receiving and holding a skateboard and a harness connected to the frame for securing the rigid frame to the back of the user.

20 Claims, 1 Drawing Sheet

QUICK RELEASE SKATEBOARD BACKPACK

BACKGROUND OF THE INVENTION

1. Field of the Invention

The invention relates to skateboards, and, in particular, to apparatus for holding skateboards. More particularly, the invention relates to apparatus for holding and carrying skateboards. Even more particularly, the present invention is related to apparatus for holding and carrying skateboards which can be worn by the user of the skateboard.

2. Description of the Related Art

Skateboard carriers and holders are known in the art. Exemplary of the prior art are the following U.S. Patents:

U.S. Pat. No. 4,790,460 discloses a skateboard carrier for transport of a skateboard which leaves use of the hands free, including a flexible resiliently deformable pad body with front and back faces configured to cover substantially the upper back of the bearer. The lateral sides of the pad body have pairs of attachment members to which cinching straps removably attach across the back face to cinchingly loop around the axle support brackets of a skateboard vertically oriented and positioned with its wheels extending outwardly. The lateral edges of the pad body at the attachment member and the attachment members are drawn tightly against the lateral margins to restrain lateral movement of the skateboard, vertical movement of which is restrained by the loops about the axle support brackets. A plurality of lateral attachment member pairs permits vertical adjustment of the board on the pad body and supplementarily provides for attachment of skateboarding accessory articles. Compact articles may be accommodated in a back face pocket.

U.S. Pat. No. 4,337,883 discloses a skateboard holder which can be removably attached to the belt of a wearer for transporting a skateboard. The skateboard holder has a rectangularly-shaped hanger formed of a flat material such as leather, in which two vertically oriented slits are formed in an upper portion thereof for attachment to a belt. Attached to two side portions of the hanger are two straps having fastening devices at their end portions so that a loop defined by the straps and hanger can be formed. The straps are formed so that each one attaches to the hanger along a predetermined length of a vertical edge thereof. Each strap tapers down so that its end portion is narrower than the predetermined length. This allows the weight of the skateboard to be supported while at the same time allowing the skateboard to be positioned as low as possible for wearer comfort. A vertically oriented skateboard having its upper wheels extending outwardly is positioned against the hanger so that a loop formed by the two straps is under the outwardly-extending upper wheels, thereby providing support for the skateboard as it is transported. In a further embodiment of the invention, a single strap extending from one side portion of the holder is provided. The end portion of the single strap is attached to the other side of the hanger so as to form a loop for holding the skateboard as in the first embodiment.

U.S. Pat. No. Des. 258,703 discloses a carrying case for a skateboard including a zippered case for receipt of a skateboard and an adjustable strap fastened to the case.

Exemplary of holding and carrying apparatus for devices other than skateboards in U.S. Pat. No. 4,518,107 which discloses a light weight carrier system primarily for use in carrying skis and/or poles on the user's back between the shoulders. The carrier system includes a pliant back body portion including a top holding strap and bottom holding strap, each with a closure device. A pair of shoulder harness straps are each attached to opposite side edges of the body portion. In use, the carrier is placed horizontally and open on a substantially flat surface with the two holding straps on top and accessible. A pair of skis having toe bindings and heel bindings, and/or a pair of ski poles are then placed on a reinforcing strip of the body portion between the two holding straps with, for example, the toe portion of the binding above one holding strap and the heel portion of the binding above the other holding strap. Both holding straps are then secured tightly around the skis an/or poles and the entire carrier system lifted and placed on the user's back and between the shoulders, preferably at an oblique vertical angle, by the two shoulder harness straps. In preferred embodiments the ski carrier system is convertible to a waist belt when it is not being used as a carrier. In one preferred embodiment a belted pack is combined with the carrier into which pack the carrier may be placed when not being used as a carrier.

SUMMARY OF THE INVENTION

In accordance with the present invention there is a provided a backpack for holding and carrying a skateboard. The skateboard backpack of the invention includes a flexible frame for receiving and holding a skateboard and a harness connected to the frame for securing the rigid frame to the back of the user.

Unlike other skateboard carriers, the backpack of the present invention permits the user to remove the skateboard from the backpack without removing the backpack from the user's back. The user can easily place his or her hand over the shoulder and slide the skateboard upwardly out of the frame.

Another advantage of the skateboard backpack of the invention is that the skateboard being carried will not bounce around and cause injury to the back of the head.

A further advantage of the skateboard backpack of the invention is that a skateboard may be easily and comfortably placed in the flexible frame while the frame is connected to the back of the user.

Furthermore, the skateboard backpack of the invention can be worn by the user with no discomfort.

BRIEF DESCRIPTION OF THE DRAWINGS

The invention will be more fully understood by reference to the drawings in which.

DESCRIPTION OF THE PREFERRED EMBODIMENTS

Figure 3:
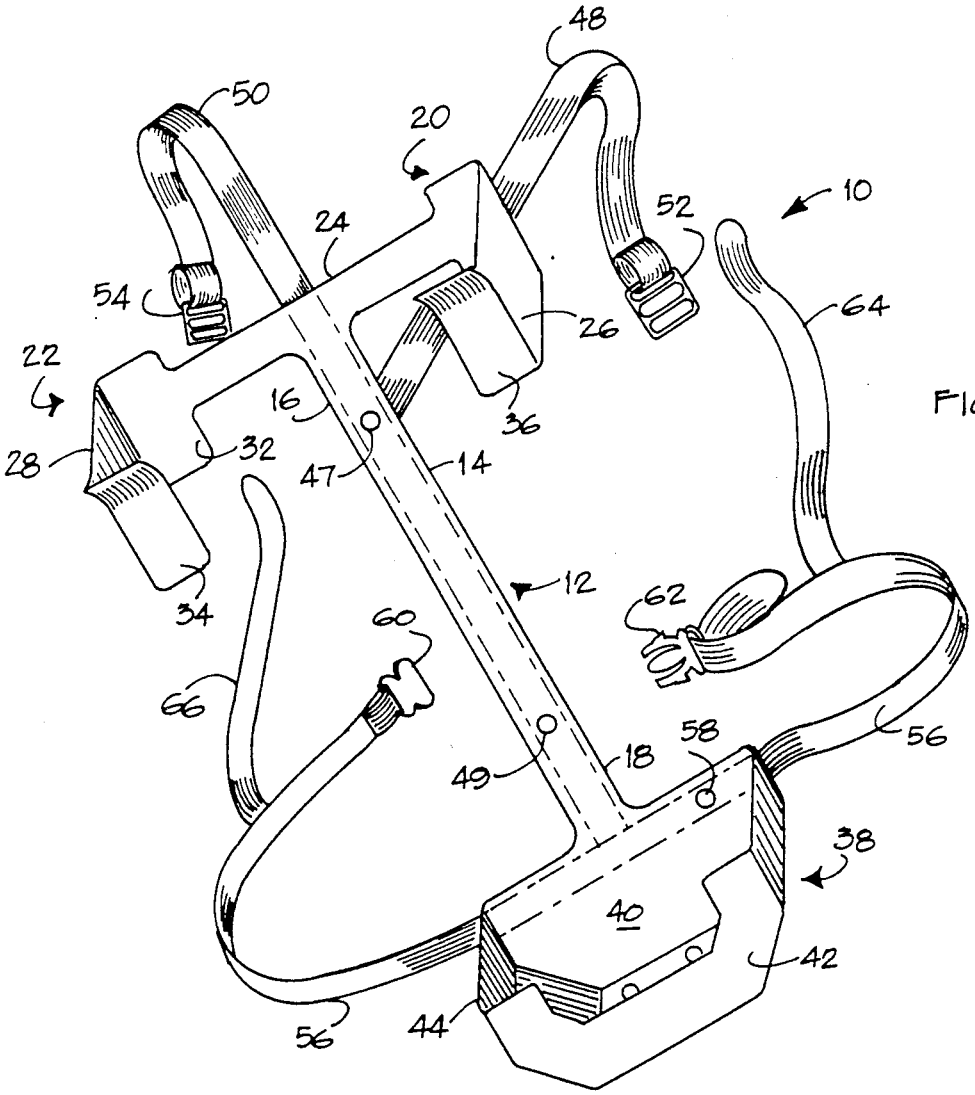
FIG. 3 is a perspective view of the skateboard backpack of the invention.

Referring now to the drawings, the skateboard backpack of the invention is generally indicated by the numeral 10. Skateboard backpack 10 includes a one piece frame shown in FIG. 3 generally indicated by the numeral 12 and a plurality of flexible straps for securing the frame 12 to the body of the user.

Frame 12 includes an elongated, spine member 14 which preferably is generally rectangular in shape. Spine member 14 has an upper end 16 and a lower end 18.

Connected to the upper end 16 of spine member 14 are skateboard guides generally indicated by the numerals 20 and 22. Skateboard guides 20 and 22 can be seen in FIG. 3 to be generally "U"-shaped channels connected to cross-member 24 which is integrally molded with spine member 14. Preferably, cross-member 24 is perpendicular to spine member 14.

Guides 20 and 22 have side walls 26 and 28 to which back walls 30 and 32 are connected perpendicularly. Side walls 26 and 28 are spaced apart from each other a distance sufficient for the side walls 26 and 28 to contact the outer edges 27 and 29 of skateboard 46 shown in FIG. 1 to hold skateboard 46 therebetween.

Side walls 26 and 28 have front walls 34 and 36 connected perpendicularly thereto on the inside thereof. Back walls 30 and 32 are spaced apart from front walls 34 and 36 a distance sufficient for a skateboard to be held securely therebetween.

Located at the lower end 18 of spine member 14 is the nose support member generally indicated by the numeral 38 which receives and holds the nose, or front end 47, of skateboard 46. Nose support member 38 includes a back plate 40 connected to a front plate 42 by nose support bottom 44. Preferably, back plate 40 is generally parallel to front plate 42. It is also preferred that nose support bottom 44 is perpendicular to back plate 40 and front plate 42. Furthermore, back plate 40 should be spaced apart a distance sufficient to receive the nose portion 47 of skateboard 46 shown in FIG. 1.

Shoulder straps 48 and 50 are rotatably connected to spine member 14 by pin 47. Shoulder straps 48 and 50 have buckles 52 and 54 connected at the ends thereof for receipt of straps 64 and 66 respectively.

Figure 2:
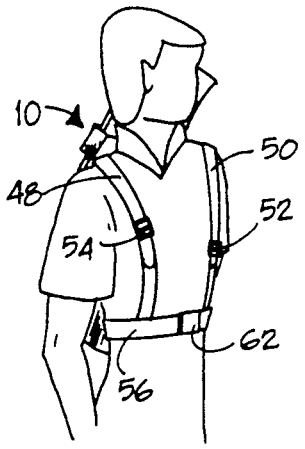
FIG. 2 is an elevational view, partly cut-away, of the front of a user of the skateboard backpack of the invention having the skateboard backpack of the invention connected thereto containing a skateboard therein.

Belt 56 is connected to nose support member 38 by pin 58. Belt 56 has fasteners 60 and 62 connected thereto for fastening the belt 56 about the waist of the user as shown in FIG. 2.

Extending upward from belt 56 are vertical straps 64 and 66. Vertical straps 64 and 66 are connectable to buckles 52 and 54 as shown in FIG. 2.

Preferably one piece frame 12 is made from a plastic material such as polyvinyl chloride or other plastic materials known in the art. The frame 12 preferably is slightly flexible so that the frame will bend rather than break if the user were to fall while wearing the skateboard backpack 10 of the invention. Frame 12 may have a hole 49 therein for receipt of a hook or nail upon which the skateboard backpack 10 of the invention may be hung.

Preferably frame 12 is painted a bright florescent color which can be easily seen during the day and reflects light at night for improved visibility. Furthermore, frame 12 should have no sharp edges which could cause injury to the user were to fall.

Figure 1:
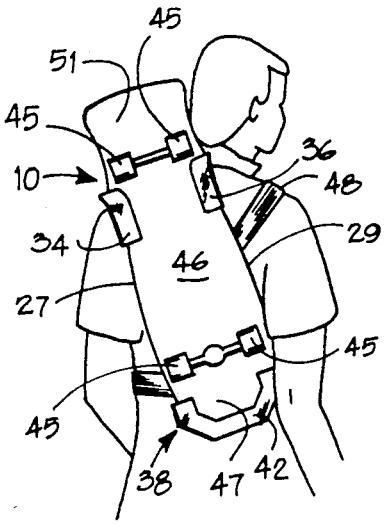
FIG. 1 is an elevational view, partly cut-away, of the back of a user of the skateboard backpack of the invention having the skateboard backpack of the invention connected thereto and containing a skateboard therein.

To use the skateboard backpack of the invention, frame 12 is placed on the back of the user as shown in FIGS. 1 and 2, and the shoulder straps 48 and 50 are placed over the shoulders of the user. Strap 48 is preferably longer than strap 50 so that frame 12 and skateboard 46 are aligned diagonally with the spine, or vertical axis, of the user. Such diagonal alignment permits the user to reach over one shoulder to insert the skateboard into frame 12 or to quickly remove the skateboard from frame 12.

Belt 56 is placed around the waist of the user and fastener 60 is connected to fastener 62. Vertical straps 64 and 66 are connected to buckles 52 and 54, respectively.

The user can then insert a skateboard 46 into frame 12 by inserting the rounded nose 47 into guides 20 and 22 with the wheels 45 connected to the bottom of skateboard 46 pointing away from the back of the user. The skateboard is pushed downward into the frame 12 until the nose 47 rests in nose support member 38.

To quickly release skateboard 46 from skateboard backpack 10, the rear end 51 of skateboard 10 is grasped by the hands of the user and pulled upward from frame 12.

Although the preferred embodiments of the present invention have been disclosed and described in detail above, it should be understood that the invention is in no sense limited thereby, and its scope is to be determined by that of the following claims.

What is claimed is:

1. A quick release skateboard backpack comprising:

a. a frame means for slidably receiving and holding a skateboard, said frame means including an upper end and a lower end, said lower end having nose support means connected thereto for receipt of the front end of said skateboard, said upper end having guide means connected thereto for guiding said front end of said skateboard to said nose support means and for holding said skateboard against said frame, and b. a plurality of strap means for strapping said frame to the back of the user of said skateboard backpack.

2. The skateboard backpack of claim 1 wherein said nose support means comprises a back plate, a front plate parallel to said back plate, and a nose support bottom connecting said front plate to said back plate.

3. The skateboard backpack of claim 2 wherein said back plate is connected to said frame means and is adapted to contact the top side of said skateboard.

4. The skateboard backpack of claim 2 wherein said front plate is adapted to contact the bottom of said skateboard.

5. The skateboard backpack of claim 2 wherein said nose support bottom is adapted to contact the front end of said skateboard.

6. The skateboard backpack of claim 1 wherein said guide means comprise a cross-member connected to said frame means, side walls connected perpendicularly to said cross-member, and front walls connected perpendicularly to said side walls on the inside thereof.

7. The skateboard backpack of claim 6 wherein said cross-member is adapted to contact the top side of said skateboard.

8. The skateboard backpack of claim 6 wherein said side walls are adapted to contact the outer edges of said skateboard.

9. The skateboard backpack of claim 6 wherein front walls are adapted to contact the top of said skateboard.

10. The skateboard backpack of claim 1 wherein said strap means comprise shoulder strap means and belt means.

11. The skateboard backpack of claim 10 wherein said belt means is connected to the lower end of said frame means.

12. The skateboard backpack of claim 11 wherein said shoulder strap means are connected to the upper end of said frame means.

13. The skateboard backpack of claim 12 wherein said belt means has vertical strap means connected thereto for fastening to said shoulder strap means.

14. The skateboard backpack of claim 13 wherein said shoulder strap means are two straps, one of said two straps being shorter than the other strap to cause said frame means to be aligned diagonally to the back of the user of said skateboard backpack.

15. The skateboard backpack of claim 1 wherein said frame means is made from a plastic material.

16. A quick release skateboard backpack comprising:

a. a frame means for slidably receiving and holding a skateboard, said frame means including an upper end and a lower end, said lower end having nose support means connected thereto for receipt of the front end of said skateboard, said upper end having guide means connected thereto for guiding said front end of said skateboard to said nose support means and for holding said skateboard against said frame, said nose support means including:

i. a back plate, ii. a front plate parallel to said back plate, and iii. a nose support bottom connecting said front plate to said back plate, said guide means including:

i. a cross-member connected to said frame means, ii. side walls connected perpendicularly to said cross member, and iii. front walls connected perpendicularly to said side walls on the inside thereof, and, b. a plurality of strap means for strapping said frame to the back of the user of said skateboard backpack.

17. The skateboard backpack of claim 16 wherein said strap means comprise shoulder strap means belt means.

18. The skateboard backpack of claim 17 wherein said belt means is connected to the lower end of said frame means.

19. The skateboard backpack of claim 18 wherein said shoulder strap means are connected to the upper end of said frame means.

20. The skateboard backpack of claim 19 wherein said belt means has vertical strap means connected thereto for fastening to said shoulder strap means.

* * * * *